US008020233B2

(12) United States Patent
Gordon

(10) Patent No.: US 8,020,233 B2
(45) Date of Patent: Sep. 20, 2011

(54) FASCINES

(75) Inventor: Peter Cronin Gordon, Liverpool (GB)

(73) Assignee: Survitec Group Limited (GB)

( * ) Notice: Subject to any disclaimer, the term of this patent is extended or adjusted under 35 U.S.C. 154(b) by 87 days.

(21) Appl. No.: 12/528,993

(22) PCT Filed: Feb. 22, 2008

(86) PCT No.: PCT/GB2008/000615

§ 371 (c)(1),
(2), (4) Date: Oct. 20, 2009

(87) PCT Pub. No.: WO2008/104748

PCT Pub. Date: Sep. 4, 2008

(65) Prior Publication Data

US 2010/0101152 A1 Apr. 29, 2010

(30) Foreign Application Priority Data

Feb. 27, 2007 (GB) ..... 0703800.3

(51) Int. Cl.
*E04H 15/20* (2006.01)

(52) U.S. Cl. ..... 14/2.4; 14/2.6; 405/15; 405/19

(58) Field of Classification Search ..... 14/2.4–2.6
See application file for complete search history.

(56) References Cited

U.S. PATENT DOCUMENTS

| | | | | |
|---|---|---|---|---|
| 4,096,701 | A * | 6/1978 | Den Boer | 405/19 |
| 4,312,601 | A * | 1/1982 | Allen | 404/35 |
| 4,566,821 | A * | 1/1986 | Knight et al. | 404/35 |
| 5,122,400 | A | 6/1992 | Stewart | |
| 6,551,030 | B1 * | 4/2003 | Curry | 405/251 |
| 7,435,034 | B2 | 10/2008 | Scott et al. | |
| 2004/0266291 | A1 * | 12/2004 | Pintz | 442/2 |
| 2008/0181723 | A1 * | 7/2008 | Connor | 404/35 |
| 2010/0028079 | A1 * | 2/2010 | Brown et al. | 404/35 |

FOREIGN PATENT DOCUMENTS

| | | |
|---|---|---|
| WO | 89/04757 | 6/1989 |
| WO | 93/06305 | 4/1993 |
| WO | 2004/009505 | 1/2004 |
| WO | 2006/027555 | 3/2006 |
| WO | 2006/027559 | 3/2006 |
| WO | 2006/136832 | 12/2006 |

* cited by examiner

*Primary Examiner* — Raymond Addie
(74) *Attorney, Agent, or Firm* — Workman Nydegger

(57) ABSTRACT

An inflatable tube (10) in a fascine is provided with a cover (11) of a braided material to provide significant strength. An outer cover (12) of KEVLAR™ may also be provided. The braided cover (11) and the inflatable tube (10) are held at the ends of the tube by a clamping mechanism (17, 18, 19) and a cylinder (40) of inflation gas is supported within the tube (10), when the tube (10) is inflated.

34 Claims, 3 Drawing Sheets

FASCINES

The invention relates to fascines.

Fascines are used, for example, to fill depressions in the ground to allow the passage of vehicles or persons over the depression. One form of fascine is described in WO2004/009505 and uses one or more inflatable tubes.

It is a problem with inflatable tubes when used in fascines that repeated wear on the exterior of the tube can puncture the tube and cause deflation. In addition, when the tube is compressed, localised increased pressure can damage the tube.

According to a first aspect of the invention, there is provided a fascine including a plurality of inflatable tubes, at least one of said tubes being provided with an external cover formed by a seamless tube of material.

The inflation of an inflatable tube in a fascine requires an inflation system including a supply of inflation gas under pressure. The inflation gas is commonly held in a container and it is a problem that, in use of the fascine, the inflation system can be damaged.

According to a second aspect of the invention, there is provided a fascine including a plurality of inflatable tubes, at least one inflatable tube being closed at one end by an end closure, the end closure mounting an inflation system including an elongate container for compressed inflation gas, the elongate container projecting into the tube from the end closure and being supported within the tube when the tube is inflated.

By locating the container within the tube and supporting the container when the tube is inflated, the container is protected against damage.

Figure 1:
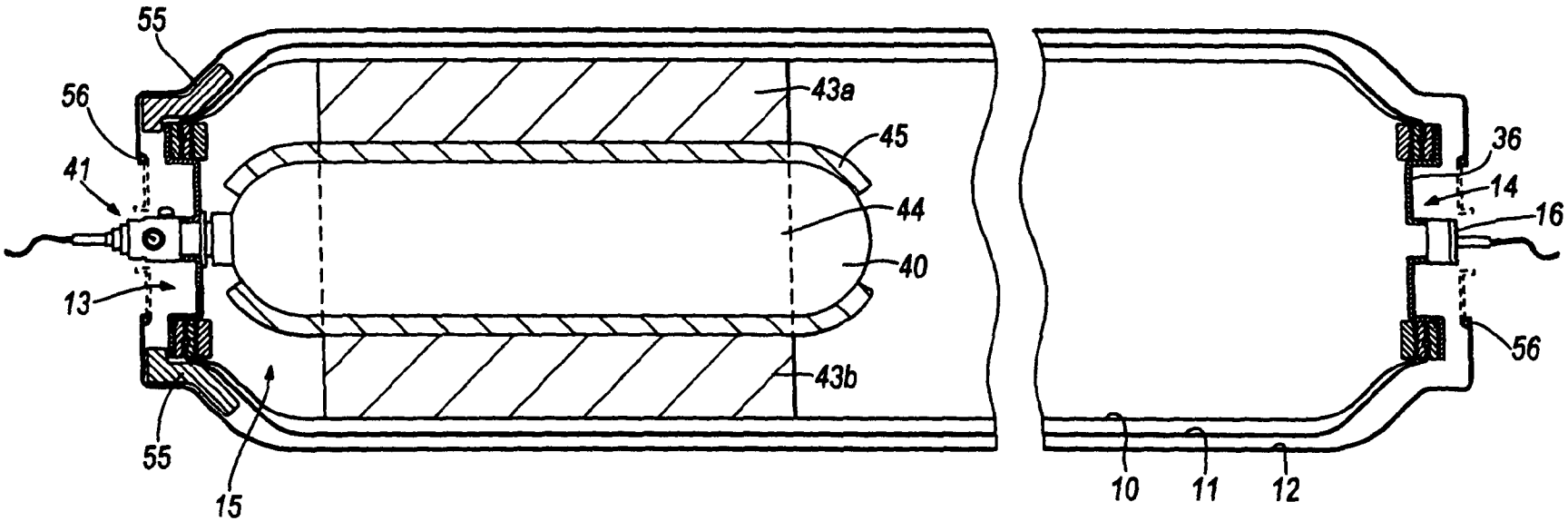
Figure 2:
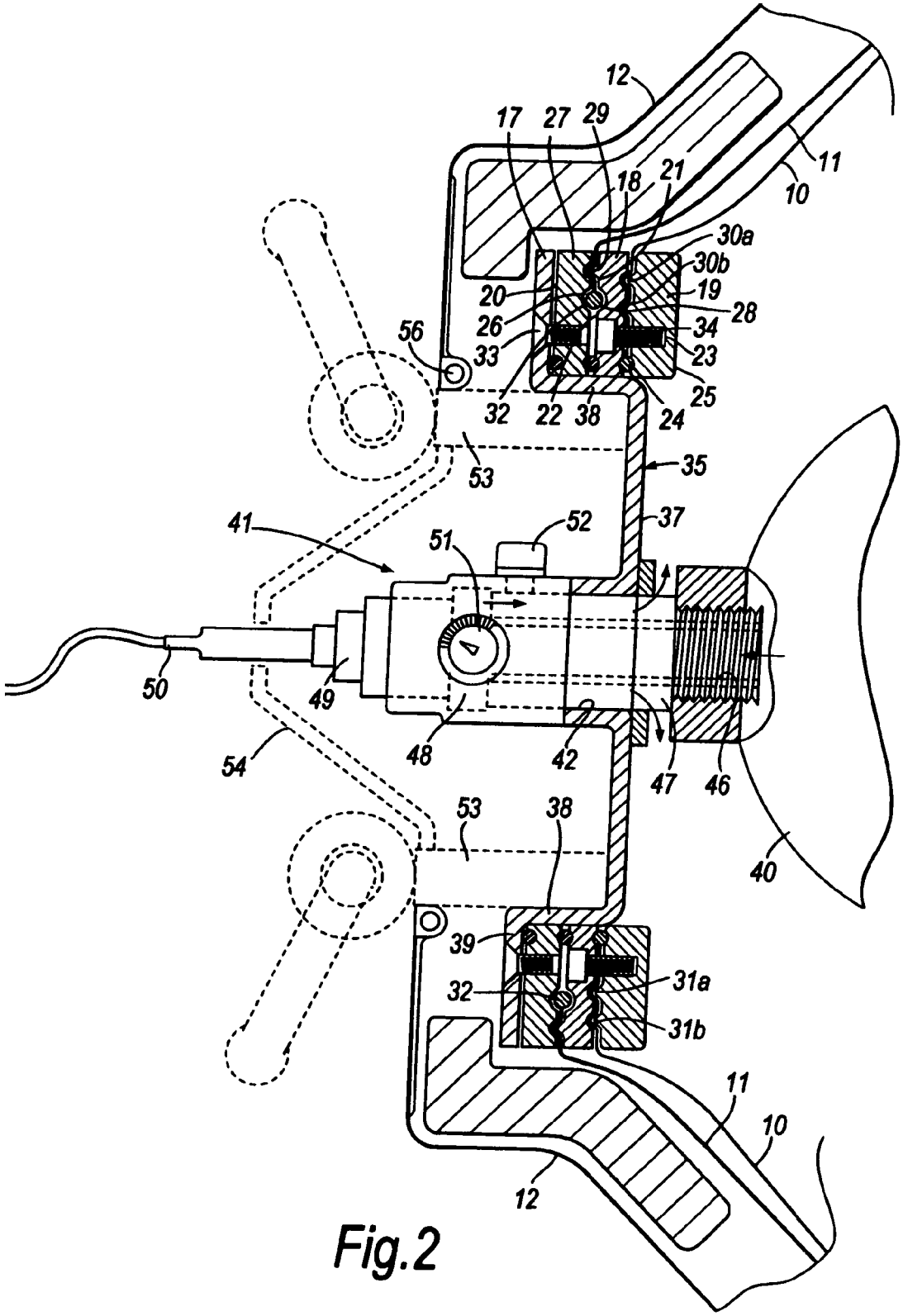
Figure 3:
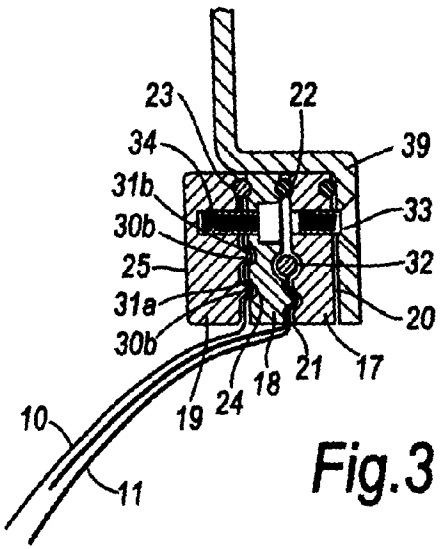
Figure 4:
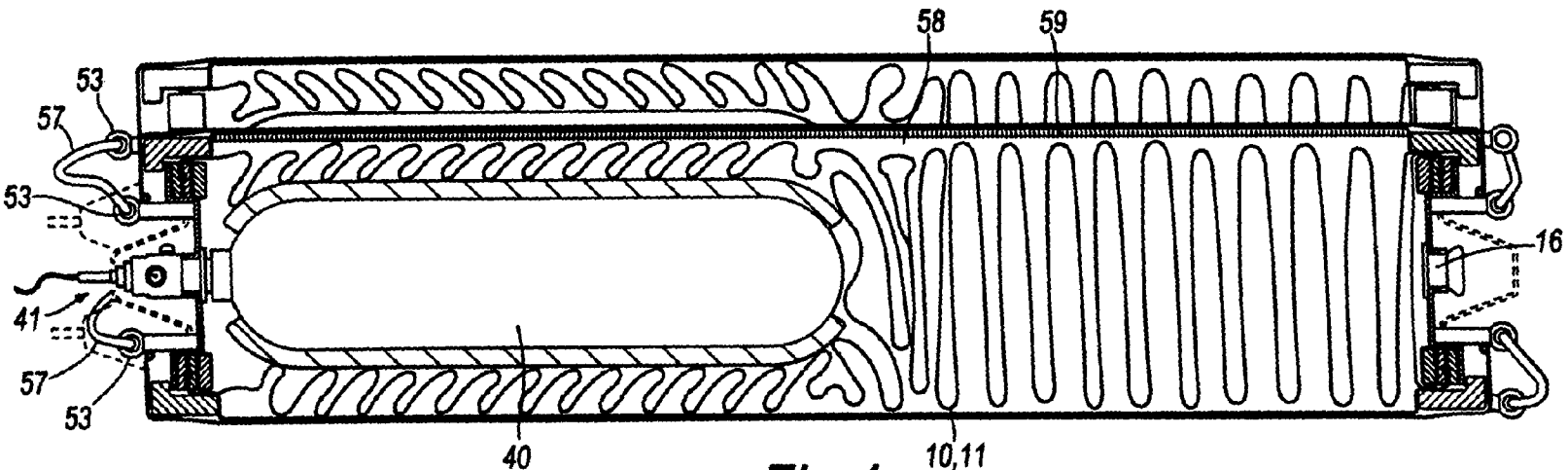

The following is a more detailed description of some embodiments of the invention, by way of example, reference being made to the accompanying drawings in which:

FIG. 1 is a partially longitudinal cross-section of an inflatable tube for incorporation in a fascine, FIG. 2 is a cross-sectional view of one end of the inflatable tube of FIG. 1 showing first, second and third clamping rings and a cover plate and showing also an inflation system mounted in the cover plate, FIG. 3 is a cross-sectional view of the clamping rings of FIG. 2, and FIG. 4 is a cross-section of two inflatable tubes of the kind shown in FIGS. 1, 2 and 3 packed in valises The inflatable tube shown in the drawings is for use in a fascine of the kind described, for example, in WO2004/099505. It will be appreciated, however, that the features of the inflatable tube could be used in any form of fascine where inflatable tubes are provided.

The inflatable tube 10 is provided with a cover 11 and an outer cover 12. The ends of the tube 10 are provided with respective first and second end closures 13, 14 with the first end closure 13 carrying an inflation system 15 and the second end closure 14 carrying a relief valve 16. All these parts will now be described in more detail.

The inflatable tube 10 is formed by a cylindrical sleeve of any suitable material such as a plastics coated fabric material. The material may be a nylon fabric with a coating of polyurethane on both inner and outer faces. The ends of the inflatable tube 10 are open as formed.

The cover 11 is in the form of a tube within which the inflatable tube 10 is received. The cover 11 is formed from a tube of braided material. Braiding is a system of three of more yarns, intertwined in such a way that no two yarns are twisted around one another. There are a variety of known braided materials and one particularly suitable braided material is formed from VECTRAN™ which is a multi-filament yarn spun from a liquid crystal polymer. It will be appreciated, however, that the braided cover 11 can be made out of any suitable material such as an aramid, for example, KEVLAR™. Alternatively it could be a woven or knitted material that is seamless.

At the ends of the inflatable tube 10, the tube 10 and the braided cover 11 are clamped by the first and second end closures 13, 14. As regards the clamping function, the first end closure 13 and the second end closure 14 are identical and so only the first end closure 13 will be described in detail.

The first end closure 13 includes first, second and third rings 17, 18, 19. The rings may, for example, be made of metal. The first, second and third rings 17, 18, 19 are concentric and of the same diameter. The first ring 17 has a front face 20 and a rear face 21. The second ring 18 has a front face 22 and a rear face 23. The third ring 19 has a front face 24 and a rear face 25. These faces lie in respective parallel planes normal to the common axis of the first, second and third rings 19. The rear face 21 of the first ring 17 abuts the front face 22 of the second ring 18 and the rear face 23 of the second ring 18 abuts the front face 24 of the third ring 19. The rear face 21 of the first ring 17 is provided an annular larger groove 26 of generally semi-circular cross-section and an annular smaller groove 27 of generally semi-circular cross-section. The front face 22 of the second ring 18 is provided with an annular groove 28 of generally semi-circular cross-section in register with the larger groove 26 on the rear face 21 of the first ring 17. In addition, the front face 22 of the second ring 18 is provided with an annular rib 29 in register with the smaller groove 27 on the rear face 21 of the first face 17.

The rear face 23 of the second ring 18 is provided with two annular grooves 30*a*, 30*b* that are in register respectively with two annular ribs 31*a*, 31*b* on the front face 24 of the third ring 19.

The end of the tube 10 is inserted between the second ring 18 and the third ring 19 and the second and third rings 18, 19 are clamped together by screws 34. The ribs 31*a*, 31*b* then engage in the grooves 30*a*, 30*b* to provide increased clamping. In this way, the end of the tube 10 is firmly connected to the end closure 14.

The end of the cover 11 is next wrapped round a hoop 32 having the same diameter as the larger groove 26 in the first ring 17. The hoop 32 is located between this larger groove 26 on the first ring and the groove 28 on the second ring and the two rings are connected together by screws 33 to clamp the end of the cover 11 to the enclosure 13. The annular rib 29 engages in the smaller groove 27 to provide increased clamping.

The first end closure 13 includes a first end plate 35 and the second end closure 14 includes a second end plate 36. These end plates 35, 36 are generally similar and so only the first end plate 35 will be described.

The first end plate 35 is formed from metal and has a generally circular central portion 37 surrounded by an annular wall 38 leading to a radially projecting flange 39. The flange 39 overlies the front face 20 of the first ring 17 and is fixed to the first ring 17 by the screws 33.

In this way, both the inflatable tube 10 and the cover 11 are securely clamped to the first end closure 13 and the second end closure 14.

The central portion 37 of the first end plate 35 mounts the inflation system 15. The inflation system 15 is formed by a cylinder 40 of compressed inflation gas and an inflation mechanism 41 connected to one end of the cylinder 40 and fitted in a central aperture 42 in the first end plate 35.

Referring once again to FIG. 1, the cylinder 40 is supported in the inflatable tube 10, when it is inflated, by supports in the form of three webs of material, two of which are shown at 43*a* and 43*b*, extending between an interior surface of the inflatable tube 10 and a sleeve 44 that surrounds and carries the cylinder 40. The webs 43*a*, 43*b* and the sleeve 44 are formed from a fabric material and the webs 43*a*, 43*b* are equiangularly spaced around the cylinder 40. As seen in FIG. 1, a resilient foam material 45 is provided between the sleeve 44 and the cylinder 40 to cushion the cylinder 40. Also seen in FIG. 1, when the inflatable tube 10 is inflated, as will be described below, the cylinder 40 is supported centrally within the inflatable tube.

The inflation mechanism 41 includes a central passage leading from the interior of the cylinder 40. The end of the passage 46 remote from the cylinder 40 connects with an annular exit passage 47 extending around the passage 46 and opening to the interior of the inflation tube 10. The connection between the outlet passage 46 and the exit passage 47 is controlled by a valve 48 that is opened and closed by an actuator 49. The actuator 49 is operated electrically via a connection 50 that leads either to a switch (not shown) or to a wireless connection (not shown) for remote operation.

A gauge 51 is provided on the inflation mechanism 41 to indicate the pressure inside the cylinder 40. When the pressure inside the cylinder 40 falls below a predetermined level, an inlet valve 52 provided on the inflation mechanism 41 can be used to re-fill the cylinder 40 from, for example, a compressor (not shown).

The first end plate 35 also carries two eyes 53 shown in broken line in FIG. 2, that extend away from the first end plate 35. The function of the eyes 53 will be described below. The eyes 53 support a conical end cover 54, also shown in broken line FIG. 2, that protects the inflation mechanism.

The second end plate 36, as seen in FIG. 1, carries the relief valve 16. The relief valve 16 is configured to release gas from the interior of the inflatable tube 10, when inflated, when the gas pressure exceeds a predetermined maximum. In addition, the relief valve 16 can be opened to deflate the inflatable tube 10. This opening may be manually or electrically. When electrical; the opening may be achieved remotely by wireless.

The outer cover 12 is a sleeve that extends over both the inflatable tube 10 and the cover 11. This may be a seamless cover, such as a braided cover. The outer cover 12 is formed from a wear-resistant material such as an aramid, for example, KEVLAR™. As seen in FIG. 1, foam-cushioning 55 may be provided between the outer cover 12 on the first end plate 35 to protect the first end plate 35 against damage. The outer cover 13 is closed by drawstrings 56 provided as respective opposite ends of the outer cover 12.

The inflatable tube 10 described above with reference to the drawings may be used in a fascine in the manner described in WO2004/099505. In such an arrangement, a number of inflatable tubes 10 are connected together and then located for use before being inflated.

For this purpose, the inflatable tube 10 described above with reference to the drawings is connected to a second similar inflatable tube by cables or wires 57 extending between the eyes 53, as shown in FIG. 4. The deflated tube 10 is packed in a valise 58 that has an opening that is normally closed by a zipper or a break open lacing system that will open when the inflatable tube 10 is inflated. The interconnected valises 58 containing the inflatable tubes 10 are located, where required, in, for example, a ditch. The inflation mechanism 41 is then operated, either locally or remotely, to operate the actuator 59 to open the valve 48. This connects the outlet passage 46 to the exit passage 47 allowing inflation gas to pass from the cylinder 40 into the interior of the inflatable tube 10. The inflatable tube 10 thus starts to inflate and bursts open the valise 58 breaking the zipper or the break open lacing system 59. The inflatable tube 10 continues to inflate until the predetermined pressure is reached when the relief valve 16 operates to release excess pressure. The inflatable tube 10 is then fully inflated in an arrangement as shown in FIG. 1. In this disposition, the cylinder 40 is supported centrally in the inflatable tube 10 by the webs 43*a*, 43*b*.

As the valise 58 is deployed into, for example, a ditch, the cylinder 40 is protected by the foam material 45 and the first end plate 35 is protected by the cushioning 55.

The braided cover 11 limits the expansion of the inflatable tube 10 under pressure. It has the following benefits compared to a woven textile stitched into a tube. First, the seamless construction increases burst strength. Secondly, the seamless construction requires virtually no manufacturing effort to form the cover as the braid is simply cut to length. Thirdly, the braided cover 11 is rigid under pressure—the braided material is essentially "less elastic" when under tension than an equivalent woven material and therefore gives greater rigidity and increased through-depth compression. Fourthly, a cut in the braided cover 11 is not propagated and therefore the braided cover 11 is "non explosive" when damaged. Failure is by leakage rather than burst. Fifthly, the braided cover 11 has high resistance to fatigue. Braided materials spread loads evenly through the structure and are more resistant to fatigue than equivalent woven material. Sixthly, braid is not expensive.

The inflatable tubes 10 form together a surface for the passage of traffic across the fascine. The wear resistant outer cover 12 presents a very durable and highly protective material that allows repeated passage without damage to the braided cover 11 or the inflatable tube 10. The drawstrings 56 allow this outer cover 12 to be readily removed and replaced so allowing the inflatable tube 10 to be re-used.

It will be appreciated there are a number of alternations that can be made to the arrangement described above with reference to the drawings. The braided cover 11 need not be used with the inflation system 15 and the relief valves 16. It could be used with any inflatable tube for a fascine. Likewise, the end clamping arrangement using the first and second end closures 13, 14 could be used on any fascine inflatable tube 10 of appropriate construction. Likewise, the support system for the cylinder 40 within the inflatable tube 10 could be used separately from the braided cover 11 and the first and second end closure 13, 14.

The inflation gas need not be contained in a cylinder; it could be contained in a container or any suitable shape. The support for the cylinder 40 within the inflatable tube 10 need not be by webs 43*a*, 43*b*; it could be by any suitable support. There could be one support or two or more supports as required.

The valise 58 need not contain just one inflatable tube. It may contain two or more such tubes. Alternatively, a plurality of valises may be provided containing respectively one or more inflatable tubes.

The invention claimed is:

1. A fascine including a plurality of inflatable tubes, at least one of said tubes being provided with an external cover formed by a seamless tube of material, an end closure being provided at least one end of the tube, the tube and the cover being connected separately to the end closure, and the end closure including first and second concentric rings, with an end of the tube being clamped between the first and second concentric rings.

2. A fascine according to claim 1 wherein the cover is formed by weaving or knitting.

3. A fascine according to claim 2 wherein the cover is formed by braiding.

4. A fascine according to claim 3 wherein the braided material is formed from a multi-filament yarn spun from a liquid crystal polymer.

5. A fascine according to claim 1 wherein the end closure includes a third ring concentric with the second ring, an end of the cover being clamped between the second and third rings.

6. A fascine according to claim 5 wherein said end of the cover is wrapped around a hoop, with the hoop and the end being clamped between the second and third rings.

7. A fascine according to claim 6 wherein the second ring and the third ring include co-operating annular surfaces, each surface being formed with a respective annular groove of generally semi-circular cross-section, the two grooves being in register and holding the hoop therebetween.

8. A fascine according to claim 5 wherein the first, second and third rings have equal diameters and are arranged co-axially in side-by-side contact.

9. A fascine according to claim 1 wherein each end of the tube has a respective closure.

10. A fascine according to claim 1 wherein the end closure includes a cover plate configured to close an associated end of the inflatable tube.

11. A fascine according to claim 10 wherein the cover plate allows access to the interior of the tube.

12. A fascine according to claim 1 wherein the end closure mounts an inflation system including an elongate container for compressed inflation gas, the elongate container projecting into the tube from the end closure and being supported within the tube when the tube is inflated.

13. A fascine according to claim 12 wherein the cylinder is supported within the tube, when the tube is inflated, by a support member extending between the container and an interior surface of the tube.

14. A fascine according to claim 13 wherein two or more support members are provided.

15. A fascine according to claim 14 wherein three support members are provided.

16. A fascine according to claim 15 wherein each support member extends in a radial direction and the support members are equiangularly spaced around the container.

17. A fascine according to claim 13 wherein the or each member is a web of flexible material.

18. A fascine according to claim 17 wherein each support member extends in a radial direction and the support members are equiangularly spaced around the container, the three webs of material being connected, at their respective radially inner ends, to a sleeve carrying the container.

19. A fascine according to claim 18 wherein a resilient material is provided between the sleeve and the container to cushion the container.

20. A fascine according to claim 19 wherein the resilient material is a foam material.

21. A fascine according to claim 12 wherein the inflation system includes an inflation mechanism attached to the container, the inflation mechanism extending through and being mounted on the closure.

22. A fascine according to claim 21 wherein the inflation system includes a valve through which compressed inflation gas may be supplied to the container.

23. A fascine according to claim 1 wherein the inflatable tube and the cover are surrounded by an outer cover of a hardwearing material.

24. A fascine according to claim 23 wherein the hardwearing material is an aramid.

25. A fascine according to claim 23 wherein the outer cover is replaceable.

26. A fascine according to claim 23 wherein a protective packing material is provided between the outer cover and the tube.

27. A fascine according to claim 1 wherein the inflatable tube includes an end closure at one end of the tube, the closure incorporating at least one mounting point for use in connecting said inflatable tube to a second inflatable tube.

28. A fascine according to claim 27 wherein the mounting point is an eye for receiving a flexible elongate member.

29. A fascine according to claim 27 wherein two mounting points are provided on the closure.

30. A fascine accordingly to claim 1 wherein said at least one inflatable tube is, in a deflated state, packed in a valise.

31. A fascine according to claim 30, wherein said valise includes at least one further inflatable tube.

32. A fascine according to claim 31 wherein the valise opens on inflation of the or an associated inflatable tube to allow the inflatable tube to deploy.

33. A fascine according to claim 32 wherein each valise includes an opening normally closed by a closure, the closure opening on inflation of the inflatable tubes.

34. A fascine according to claim 33 wherein the closure is a zipper or a break open lacing system.

* * * * *

UNITED STATES PATENT AND TRADEMARK OFFICE

CERTIFICATE OF CORRECTION

PATENT NO. : 8,020,233 B2
APPLICATION NO. : 12/528993
DATED : September 20, 2011
INVENTOR(S) : Peter C. Gordon It is certified that error appears in the above-identified patent and that said Letters Patent is hereby corrected as shown below:

Drawings

Sheet 3, replace Figure 3 with the figure depicted below, wherein the lower instance of reference number "30b" has been changed to --30a--

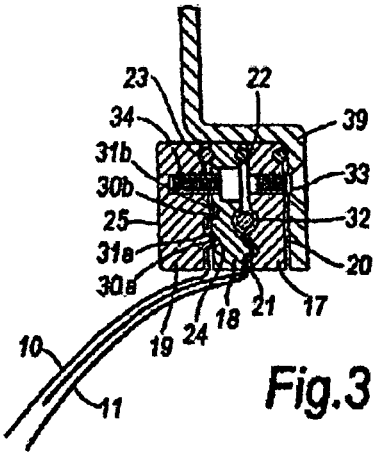

Fig.3

Column 1

Line 44, change "valises" to --valises.--

Column 2

Line 19, change "19" to --17, 18, 19--

Column 3

Line 32, change "line FIG. 2" to --line in FIG. 2--
Line 38, change "electrically" to --electrically controlled--
Line 47, change "outer cover 13" to --outer cover 12--

Column 4

Line 1, change "break open lacing system 59" to --break open lacing system--

Signed and Sealed this
Tenth Day of January, 2012

David J. Kappos

David J. Kappos
*Director of the United States Patent and Trademark Office*

Column 5
Line 43, change “wherein the or each” to --wherein each--

Column 6
Line 34, change “accordingly” to --according--
Line 39, change “of the or an” to --of an--